US008156724B2

(12) United States Patent
Milner

(10) Patent No.: US 8,156,724 B2
(45) Date of Patent: Apr. 17, 2012

(54) COMBUSTION CHAMBER

(75) Inventor: Glynn Milner, Fiskerton (GB)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/679,366

(22) PCT Filed: Sep. 5, 2008

(86) PCT No.: PCT/EP2008/061801

§ 371 (c)(1),
(2), (4) Date: Mar. 22, 2010

(87) PCT Pub. No.: WO2009/040232

PCT Pub. Date: Apr. 2, 2009

(65) Prior Publication Data

US 2010/0218509 A1 Sep. 2, 2010

(30) Foreign Application Priority Data

Sep. 24, 2007 (EP) ..... 07018754

(51) Int. Cl.

| | |
|---|---|
| ***F23R 3/26*** | (2006.01) |
| ***F02C 1/00*** | (2006.01) |
| ***F02C 7/12*** | (2006.01) |

(52) U.S. Cl. ..... 60/39.23; 60/752; 60/806

(58) Field of Classification Search ..... 60/39.23, 60/752, 754, 755, 757, 758, 759, 760
See application file for complete search history.

(56) References Cited

U.S. PATENT DOCUMENTS

| | | | | |
|---|---|---|---|---|
| 2,655,787 | A * | 10/1953 | Brown | 60/39.23 |
| 2,837,893 | A | 6/1958 | Schirmer | |
| 3,057,158 | A * | 10/1962 | Miller | 60/39.23 |

FOREIGN PATENT DOCUMENTS

| | | | |
|---|---|---|---|
| DE | 2737773 | A1 | 3/1978 |
| EP | 1058061 | A1 | 12/2000 |
| EP | 1826492 | A1 | 8/2007 |
| EP | 1936468 | A1 | 6/2008 |
| GB | 721209 | | 9/1952 |

* cited by examiner

*Primary Examiner* — Ehud Gartenberg
*Assistant Examiner* — Arun Goyal

(57) ABSTRACT

A combustion chamber is provided, including an inner casing with a sliding surface and an outer casing with a sliding wall portion. The sliding surface and the sliding wall portion are slidably attached to each other. A cooling hole is located in the sliding wall portion. The cooling hole is at least partially located in the sliding wall portion such that it opens due to a sliding movement of the sliding surface relative to the sliding wall portion when the inner casing thermally expands and/or closes due to a sliding movement of the sliding surface relative to the sliding wall portion when the inner casing thermally contracts. Moreover, a gas turbine including an inventive combustion chamber is disclosed.

18 Claims, 3 Drawing Sheets

COMBUSTION CHAMBER

CROSS REFERENCE TO RELATED APPLICATIONS

This application is the US National Stage of International Application No. PCT/EP2008/061801, filed Sep. 5, 2008 and claims the benefit thereof. The International Application claims the benefits of European Patent Office application No. 07018754.7 EP filed Sep. 24, 2007. All of the applications are incorporated by reference herein in their entirety.

FIELD OF INVENTION

The present invention relates to a combustion chamber, in particular to a pre-chamber of a gas turbine combustor, with cooling arrangement.

BACKGROUND OF INVENTION

A gas turbine usually comprises a compressor, a combustor and a turbine. The compressor compresses air which is fed to the combustor where it is mixed with fuel. Inside a combustion chamber the resulting fuel-air mixture is combusted. During the combustion of fuel and air hot combustion gas is generated. This combustion gas is used to drive the turbine. A typical combustor comprises a burner, a pre-chamber which is located close to the burner, and a main combustion chamber. Especially the pre-chamber is exposed to very high temperatures due to its location near the burner. If the pre-chamber reaches a certain temperature it is prone to carbon build-up and then the metal of the pre-chamber casing may be negatively affected.

To protect the pre-chamber components cooling holes are added to the pre-chamber casing. Cooling with, for instance, compressed air limits the maximum temperature of the pre-chamber. However, the air which is used for cooling could also otherwise be doing work in the turbine and thus has an impact on the efficiency of the turbine, even though it is only a minor impact.

SUMMARY OF INVENTION

It is therefore an objective of the present invention to provide a combustion chamber with improved cooling. It is a further objective of the present invention to provide an advantageous gas turbine.

The first objective is solved by a combustion chamber, as claimed in the claims. The second objective is solved by a gas turbine, as claimed in the claims. The depending claims define further developments of the invention.

The inventive combustion chamber comprises an inner casing with a sliding surface and an outer casing with a sliding wall portion. The sliding surface and the sliding wall portion are slidably attached to each other in at least one attachment zone. The inventive combustion chamber further comprises at least one cooling hole which is situated in the sliding wall portion. This cooling hole is at least partially located in such the sliding wall portion that it opens due to a sliding movement of the sliding surface relative to the sliding wall portion when the inner casing thermally expands and/or closes due to a sliding movement of the sliding surface relative to the sliding wall portion when the inner casing thermally contracts. This means that the cooling hole opens and closes due to thermal expansion and contraction of the inner casing while the outer casing, which is cooled by compressor air, has nearly a constant temperature and therefore does not expand or contract. Preferably, the inventive combustion chamber may comprise a number of such cooling holes.

The invention exploits the temperature difference between the inner casing and the outer casing of the combustion chamber. The temperature of the outer casing is dominated by the temperature of the compressed air coming from the compressor. Typically a flow channel comprising the compressed air surrounds the outer casing of the combustion chamber. Therefore, the temperature of the outer casing is quite constant. In contrast, the temperature of the inner casing is dominated by the flame temperature, which varies depending on the existence and the characteristics of the flame. This means that high temperatures inside the combustion chamber cause an expansion of the inner casing while the outer casing nearly keeps its shape. During the expansion of the inner casing the cooling hole is opening. The open cooling hole provides the hot inner casing with sufficient cooling air. If the inner casing cools down again it contracts and the cooling hole closes automatically due to this contraction. Hence, the invention provides simple means for variable cooling of the inner casing so that the cooling flow is increased when needed at conditions when the flame temperature is high which is at high loads.

The cooling hole may have a round, triangular, rectangular or trapezoid opening cross-section. By the shape of the hole's opening cross-section one can determine the amount of increase in cooling fluid flow associated to a slide movement of the sliding surface relative to the sliding wall portion. The shape of the cooling hole and its cross-section may thus be adapted to the desired cooling flow which is to be achieved for a particular temperature.

The combustion chamber can further comprise a pre-chamber area and the sliding surface and the sliding wall portion may be located in this pre-chamber area. Moreover, the combustion chamber may comprise a downstream end where the inner casing and the outer casing are joined together. In this case, the sliding surface of the inner casing and the sliding wall portion of the outer casing would advantageously be slidably attached to each other at the upstream end of the combustion chamber as the relative movement due to thermal expansion of the inner casing is the greatest in this area.

Preferably, the inner casing may comprise at least one spacer which is located between the outer casing and the inner casing. The sliding surface is then a face of the spacer which shows towards the outer casing. The spacer may especially be a location ring. The spacer or location ring provides a sufficient distance between the inner and the outer casing. The occurring space between the inner and the outer casing can be used as a cooling flow channel.

Generally, the combustion chamber may, for instance, be a Dry Low Emission (DLE) combustion chamber.

The inventive gas turbine comprises a combustion chamber as previously described. The inventive gas turbine also has the advantages of the in inventive combustion chamber.

BRIEF DESCRIPTION OF THE DRAWINGS

Further features, properties and advantages of the present invention will become clear from the following description of an embodiment in conjunction with the accompanying drawings.

DETAILED DESCRIPTION OF INVENTION

Figure 1:
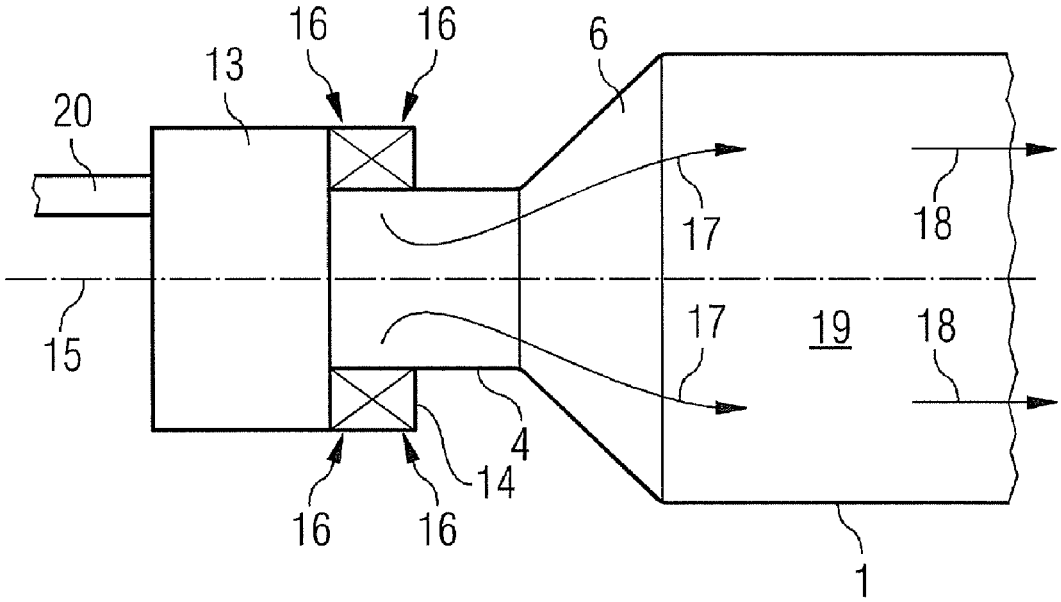
FIG. 1 schematically shows a longitudinal section through a combustor.

An embodiment of the present invention will now be described with reference to FIGS. 1 to 7. FIG. 1 schematically shows a longitudinal section through a combustor. The combustor comprises a burner with a swirler portion 14 and a burner-head portion 13 attached to the swirler portion 14, a transition piece being referred to as a combustion pre-chamber 4 and a main combustion chamber 1 arranged in flow series. The main combustion chamber 1 has a larger diameter than the diameter of the pre-chamber 4. The main combustion chamber 1 is connected to the pre-chamber 4 at the upstream end 6. In general, the pre-chamber 4 may be implemented as a one part continuation of the burner-head 13 towards the combustion chamber 1, as a one part continuation of the combustion chamber 4 towards the burner-head 13 or as a separate part between the burner-head 13 and the combustion chamber 1. The burner and the combustion chamber 1 assembly show rotational symmetry about a longitudinal symmetry axis 15.

A fuel duct 20 is provided for leading a gaseous or liquid fuel to the burner which is to be mixed with in-streaming air 16 in the swirler 14. The fuel-air-mixture 17 is then led towards the primary combustion zone 19 where it is burnt to form hot, pressurised exhaust gases flowing in a direction 18 indicated by arrows to a turbine of the gas turbine engine (not shown).

Figure 2:
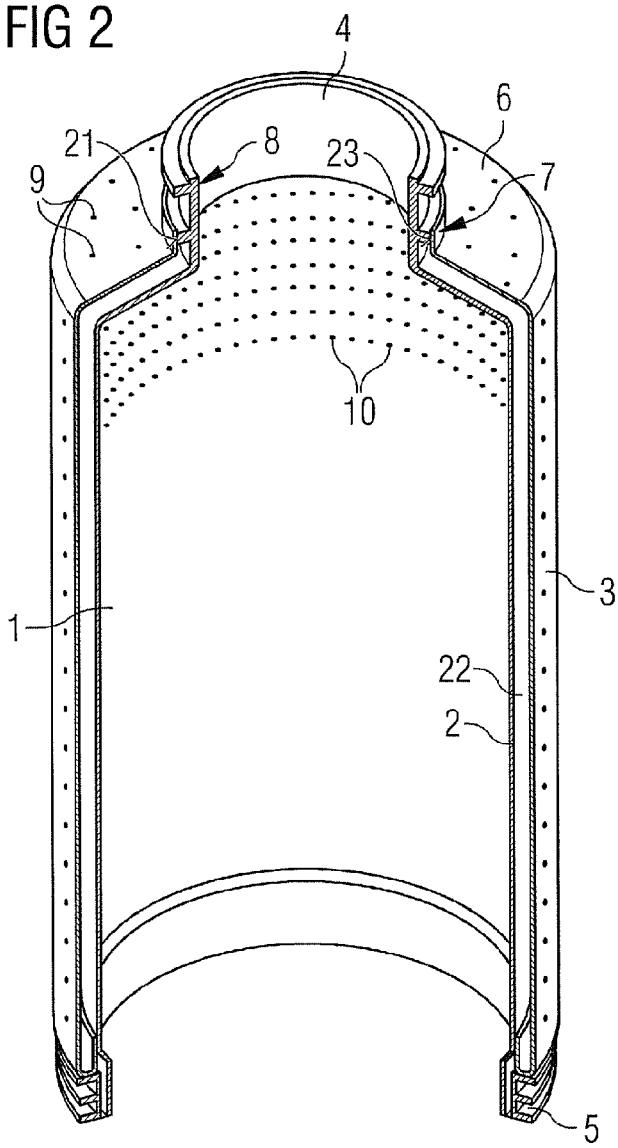
FIG. 2 schematically shows part of a combustion chamber in a perspective view.

FIG. 2 schematically shows part of the main combustion chamber 1 and the pre-chamber 4 in a perspective sectional view. The main combustion chamber 1 comprises an upstream end 6 and a downstream end 5. At the upstream end 6 the combustion chamber 1 comprises a narrow section which forms the pre-chamber 4. Alternatively, the main combustion chamber 1 may be connected to the pre-chamber 4 which is implemented as an individual element. Moreover, the main combustion chamber 1 and, in particular, the pre-chamber 4, comprises an inner casing 2 and an outer casing 3. The inner casing 2 and the outer casing 3 are joined together at the downstream end 5 and slide near the upstream end 6 at an attachment zone 7 to allow for differential expansion. The inner casing 2 comprises a location ring 8 which is situated at the upstream end 6 near the pre-chamber 4. One surface of the location ring 8 is in sliding contact with the outer casing 3. This surface forms a sliding surface 23 of the inner casing 2 which provides together with a sliding wall portion 21 of the outer casing 3 the attachment zone 7.

There is an internal space 22 between the inner casing 2 and the outer casing 3 which may be used as cooling air channel for cooling the inner casing 2. For this purpose the outer casing 3 comprises cooling holes 9, which is in flow connection with the internal space 22 for leading cooling air into the internal space 22 to cool the inner casing 2. Furthermore, the inner casing 2 comprises cooling holes 10, which lead the used cooling air into the main combustion chamber 1. Especially the cooling holes 9 in the outer casing 3 are usually placed at the upstream end 6 of the outer casing 3 to cool the pre-chamber 4.

The inventive combustion chamber 1 further comprises cooling holes 11 in the sliding wall portion 21 of the outer casing 3, i.e. where the attachment zone 7 is located. These holes 11 may be positioned where they would be fully open at maximum differential temperature and partially closed, and thus providing lower cooling flow, when the flame temperature falls. Due to the falling temperature, the inner casing 2 contracts relative to the outer casing 3, and as a consequence, the location ring 8 partially covers the holes.

Figure 3:
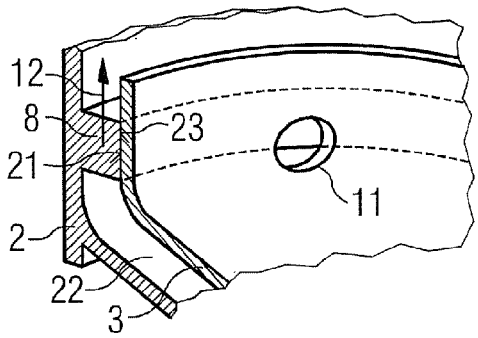
FIG. 3 schematically shows the sliding surface of the inner casing and the sliding wall portion of the outer casing with a cooling hole in a perspective view.

FIG. 3 schematically shows the position of an inventive cooling hole 11 in a perspective view. One can see in FIG. 3 part of the upstream end 6 of the main combustion chamber 1. Especially, one can see part of the inner casing 2 comprising a location ring 8 and the sliding wall portion 21 of the outer casing 3 which is in sliding contact with the sliding surface 23 of the location ring 8.

The sliding wall portion 21 of the outer casing 3 comprises a cooling hole 11 which has a round opening cross-section. This cooling hole 11 is situated such that it is partially covered by the sliding surface 23 of the location ring 8. If the inner casing 2 becomes hot, especially while the combustion chamber 1 is in use, then the inner casing 2 expands compared to the outer casing 3. The inner casing 2 expands in the direction which is indicated by an arrow 12 due to the fact that the downstream ends of the inner casing 2 and the outer casing 3 are joined together. Due to this movement, the cooling hole 11 opens further and more cooling air, or any other cooling fluid, can enter through the cooling hole 11 into the internal space 22 between the inner casing 2 and the outer casing 3.

Figure 4:
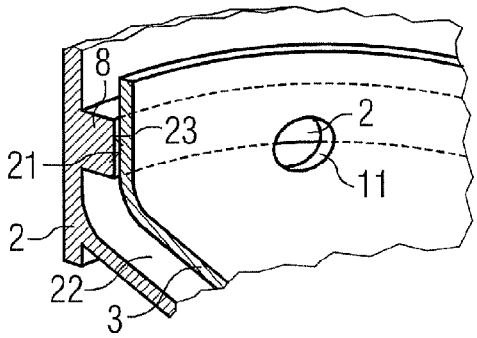
FIG. 4 schematically shows a partially open cooling hole in the outer casing in a perspective view.

FIG. 4 schematically shows the cooling hole 11 when it is partially open in a perspective view. As in FIG. 3 one can see the location ring 8 with the sliding surface 23 of the inner casing 2 and the sliding wall portion 21 of the outer casing 3. The outer casing 3 comprises a cooling hole 11 which has a round opening cross-section. The cooling hole 11 is placed such in the sliding wall portion 21 of the outer casing 3 that the sliding surface 23 of the location ring 8 partially covers the cooling hole 11. The cooling hole 11 may be partially closed or fully covered by the sliding surface 23 if the inner casing 2 has the same temperature as the outer casing 3. This is the case, for example, when the combustion chamber 1 is not in operation.

Figure 5:
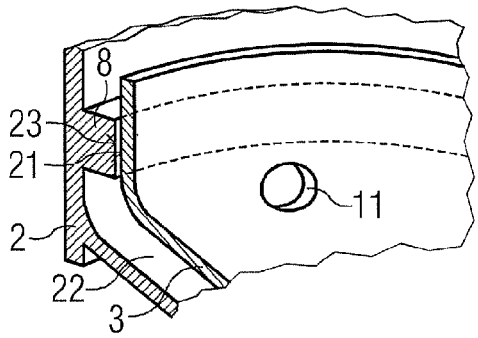
FIG. 5 schematically shows a fully open cooling hole in the outer casing in a perspective view.

FIG. 5 schematically shows the cooling hole 11 in a perspective view when the inner casing 2 has a higher temperature than the outer casing 3. In this case, the inner casing 2 is expanded compared to the outer casing 3 due to the increased temperature inside the combustion chamber 1. This means that the location ring 8 has been moving vertically relative to the outer casing 3. Because of this movement the sliding surface 23 of the location ring 8 is no longer able to cover the cooling hole 11 either partially or fully. Therefore, the cooling hole 11 is fully open in FIG. 5. Now the maximum cooling fluid flow can enter the cooling hole 11 and may impinge at the inner casing 2 and flow through the internal space 22.

Figure 6:
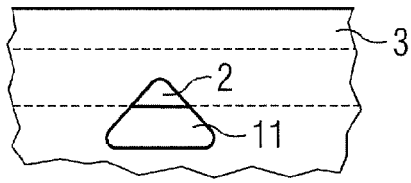
FIG. 6 schematically shows a partially open triangular cooling hole in a frontal view.
Figure 7:
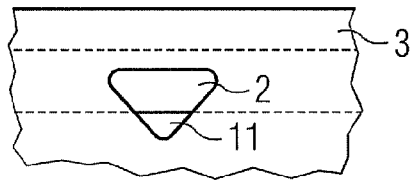
FIG. 7 schematically shows a partially open alternative triangular cooling hole in a frontal view.

The position and shape of the cooling hole 11 can be optimised to satisfy absolute flow requirements and to set a desired dependence of the change in cooling air flow through the hole with expanding inner casing 2. Examples of an alternative cross-section of the cooling hole 11 are shown in FIGS. 6 and 7. FIGS. 6 and 7 schematically show a cooling hole 11 with a triangular cross-section in a frontal view. In both figures the cooling hole 11 is positioned in the sliding wall portion 21 of the outer casing 3 such that the inner casing 2, more precisely the sliding surface 23 of the location ring 8, partially covers the cooling hole 11. In FIG. 6 the cooling hole 11 is positioned such in the sliding wall portion 21 of the outer casing 3 that one vertex of its triangular cross-section points in the direction of the pre-chamber 4. In contrast, in FIG. 7 one vertex of the triangular cross-section of the cooling hole 11 points in the direction of the downstream end 5 of the combustion chamber 1. Both configurations provide a non-linear change of the cooling fluid flow during the expansion of the inner casing 2.

In summary, the inventive combustion chamber 1, especially the provision and location of the cooling hole 11, increases the efficiency of the combustion chamber because it provides a cooling fluid flow which is adapted to the temperature of the inner casing 2. This means that the cooling flow is low in the case of a low temperature of the inner casing 2 and the cooling flow increases as the temperature of the inner casing 2 increases.

The invention claimed is:

1. A combustion chamber, comprising:

an inner casing including a sliding surface;

an outer casing including a sliding wall portion; and a cooling hole disposed in the sliding wall portion, the cooling hole being operable to conduct cooling air into a cooling channel between the inner casing and the outer casing;

wherein the sliding surface and the sliding wall portion are slidably attached to each other, and wherein the cooling hole is at least partially located in the sliding wall portion such that the cooling hole opens due to a sliding movement of the sliding surface relative to the sliding wall portion when the inner casing thermally expands and/or closes due to the sliding movement when the inner casing thermally contracts.

2. The combustion chamber as claimed in claim 1, wherein the cooling hole includes a round opening cross-section.

3. The combustion chamber as claimed in claim 1, wherein the cooling hole includes a triangular opening cross-section.

4. The combustion chamber as claimed in claim 1, wherein the cooling hole includes a rectangular opening cross-section.

5. The combustion chamber as claimed in claim 1, wherein the cooling hole includes a trapezoidal opening cross-section.

6. The combustion chamber as claimed in claim 1, wherein the combustion chamber further comprises a pre-chamber area, and wherein the sliding surface and the sliding wall portion are located in the outer casing of the pre-chamber area.

7. The combustion chamber as claimed in claim 1, wherein the combustion chamber further comprises a downstream end where the inner casing and the outer casing are joined together.

8. The combustion chamber as claimed in claim 1, wherein the inner casing comprises a spacer between the outer casing and the inner casing, and wherein the sliding surface is a face of the spacer which shows towards the outer casing.

9. The combustion chamber as claimed in claim 8, wherein the spacer is a location ring.

10. A gas turbine, comprising:

a combustion chamber, comprising:

an inner casing including a sliding surface, an outer casing including a sliding wall portion, and a cooling hole disposed in the sliding wall portion, the cooling hole being operable to conduct cooling air into a cooling channel between the inner casing and the outer casing, wherein the sliding surface and the sliding wall portion are slidably attached to each other, and wherein the cooling hole is at least partially located in the sliding wall portion such that the cooling hole opens due to a sliding movement of the sliding surface relative to the sliding wall portion when the inner casing thermally expands and/or closes due to the sliding movement when the inner casing thermally contracts.

11. The gas turbine as claimed in claim 10, wherein the cooling hole includes a round opening cross-section.

12. The gas turbine as claimed in claim 10, wherein the cooling hole includes a triangular opening cross-section.

13. The gas turbine as claimed in claim 10, wherein the cooling hole includes a rectangular opening cross-section.

14. The gas turbine as claimed in claim 10, wherein the cooling hole includes a trapezoidal opening cross-section.

15. The gas turbine as claimed in claim 10, wherein the combustion chamber further comprises a pre-chamber area, and wherein the sliding surface and the sliding wall portion are located in the outer casing of the pre-chamber area.

16. The gas turbine as claimed in claim 10, wherein the combustion chamber further comprises a downstream end where the inner casing and the outer casing are joined together.

17. The gas turbine as claimed in claim 10, wherein the inner casing comprises a spacer between the outer casing and the inner casing, and wherein the sliding surface is a face of the spacer which shows towards the outer casing.

18. The gas turbine as claimed in claim 17, wherein the spacer is a location ring.

* * * * *